US007627268B2

(12) United States Patent
Katoh et al.

(10) Patent No.: US 7,627,268 B2
(45) Date of Patent: Dec. 1, 2009

(54) IMAGE FORMING APPARATUS CAPABLE OF PROVIDING A STABLE BELT MOVEMENT IN A BELT UNIT

(75) Inventors: Tsutomu Katoh, Kawasaki (JP); Mitsuru Takahashi, Kawasaki (JP); Kazuchika Saeki, Atsugi (JP); Kazuosa Kuma, Yokohama (JP); Nobuto Yokokawa, Yokohama (JP); Takeshi Fukao, Yokohama (JP)

(73) Assignee: Ricoh Co., Ltd., Tokyo (JP)

( * ) Notice: Subject to any disclaimer, the term of this patent is extended or adjusted under 35 U.S.C. 154(b) by 374 days.

(21) Appl. No.: 11/608,008

(22) Filed: Dec. 7, 2006

(65) Prior Publication Data

US 2007/0127955 A1 Jun. 7, 2007

(30) Foreign Application Priority Data

Dec. 7, 2005 (JP) ..... 2005-353254

(51) Int. Cl.
*G03G 15/01* (2006.01)
*G03G 15/16* (2006.01)

(52) U.S. Cl. ..... 399/121; 399/303; 399/308

(58) Field of Classification Search ..... 399/116, 399/121, 162, 164, 303, 312, 313, 302, 308
See application file for complete search history.

(56) References Cited

U.S. PATENT DOCUMENTS 4,551,001 A * 11/1985 Yokota ..... 399/116
4,674,858 A * 6/1987 Nagayama ..... 399/116
5,122,836 A * 6/1992 Fujiwara et al. ..... 399/116
5,172,175 A * 12/1992 Sekino et al. ..... 399/303
5,175,589 A * 12/1992 Kimura ..... 399/121
5,400,121 A * 3/1995 Foote ..... 399/116
5,585,892 A * 12/1996 Hayano et al. ..... 399/164
5,870,650 A 2/1999 Takahashi et al.
6,006,062 A 12/1999 Takahashi et al.
6,035,157 A 3/2000 Takahashi et al.
6,125,994 A * 10/2000 Todome ..... 399/312
6,223,008 B1 4/2001 Takahashi et al.
RE37,157 E * 5/2001 Ikeda et al. ..... 399/124
6,397,033 B1 * 5/2002 Todome ..... 399/303
6,445,900 B2 9/2002 Fukao et al.

(Continued)

FOREIGN PATENT DOCUMENTS

JP 2003-171030 6/2003

(Continued)

OTHER PUBLICATIONS

U.S. Appl. No. 11/934,981, filed Nov. 5, 2007, Furuya, et al.

(Continued)

*Primary Examiner*—Susan S Lee
(74) *Attorney, Agent, or Firm*—Oblon, Spivak, McClelland, Maier & Neustadt, L.L.P.

(57) ABSTRACT

An image forming apparatus includes a belt unit having a support roller, a tension roller, a pair of side frames, a belt, and a guiding mechanism. The pair of side frames are configured to support the support roller and the tension roller. The belt extends across the support roller and the tension roller. The guiding mechanism are configured to guide the tension roller of the belt unit.

11 Claims, 4 Drawing Sheets

U.S. PATENT DOCUMENTS

| | | | | |
|---|---|---|---|---|
| 6,690,905 | B2 | 2/2004 | Takahashi et al. | |
| 6,697,595 | B2 | 2/2004 | Kawagoe et al. | |
| 6,785,500 | B2 | 8/2004 | Takahashi et al. | |
| 6,868,248 | B2 | 3/2005 | Fukao et al. | |
| 6,949,896 | B2 | 9/2005 | Andoh et al. | |
| 7,110,700 | B2 | 9/2006 | Andoh et al. | |
| 7,313,345 | B2 * | 12/2007 | Inaba et al. | 399/113 |
| 2001/0022903 | A1 * | 9/2001 | Shirasawa et al. | 399/116 |
| 2002/0021916 | A1 * | 2/2002 | Wakana | 399/121 |
| 2004/0165909 | A1 * | 8/2004 | Asaoka et al. | 399/116 |
| 2005/0047816 | A1 | 3/2005 | Uchida et al. | |
| 2005/0053388 | A1 | 3/2005 | Yokoyama et al. | |
| 2005/0074259 | A1 * | 4/2005 | Tachiki et al. | 399/121 |
| 2005/0169667 | A1 | 8/2005 | Katoh | |
| 2005/0265755 | A1 | 12/2005 | Takahashi | |
| 2006/0062593 | A1 | 3/2006 | Takahashi | |
| 2006/0072929 | A1 | 4/2006 | Takahashi | |
| 2006/0165442 | A1 | 7/2006 | Kobayashi et al. | |
| 2006/0210307 | A1 | 9/2006 | Katoh et al. | |
| 2006/0210324 | A1 | 9/2006 | Kuma et al. | |

FOREIGN PATENT DOCUMENTS

| | | |
|---|---|---|
| JP | 2003-287867 | 10/2003 |
| JP | 2005-070509 | 3/2005 |

OTHER PUBLICATIONS

U.S. Appl. No. 11/943,941, filed Nov. 21, 2007, Katoh, et al.

* cited by examiner

IMAGE FORMING APPARATUS CAPABLE OF PROVIDING A STABLE BELT MOVEMENT IN A BELT UNIT

CROSS-REFERENCE TO RELATED APPLICATION

This patent specification is based on Japanese patent application, No. 2005-353254 filed on Dec. 7, 2005 in the Japan Patent Office, the entire contents of which are incorporated by reference herein.

BACKGROUND

1. Field of Invention

Exemplary aspects of the present invention relate to an image forming apparatus, and more particularly to an image forming apparatus capable of providing a stable belt movement in a belt unit.

2. Description of the Related Art

A related art image forming apparatus with a detachable belt unit has been known to form a toner image (e.g., a monochrome image or a color image) on a transfer sheet. The detachable belt unit includes, for example, an detachable intermediate transfer unit and a detachable sheet conveyance unit. The intermediate transfer unit includes an intermediate transfer belt on which the toner image is transferred before being transferred onto a transfer sheet, and the sheet conveyance unit includes a sheet conveyance belt by which the transfer sheet is conveyed in a process of forming the toner image on the transfer sheet.

One example of the related art image forming apparatus employs the detachable intermediate transfer unit including the intermediate transfer belt and a support member that supports the intermediate transfer belt to provide a quality image. Another example employs the sheet conveyance belt that has a high stability to meet a demand for a higher conveyance speed of the transfer sheet resulting from an increased output speed of the image forming process. Still another example employs the intermediate transfer belt unit and sheet conveyance belt unit to form a full color image by superimposing one color image on another with a tandem system of a plurality of image forming mechanisms. This tandem system can provide a full color image at a speed as fast as forming of a monochrome image.

These belts such as the intermediate transfer belt and sheet conveyance belt included in the detachable belt units, generally deteriorate over time. Accordingly, each belt should be replaced after a certain amount thereof is consumed. The intermediate transfer belt, for example, should be replaced so that an occurrence of deteriorating the image quality caused by the deterioration of the intermediate transfer belt may be reduced.

The detachable belt unit in the relate art image forming apparatus applies a rigid frame, for example, a sheet metal for front and rear plates, and an extruded aluminum for a stay. Thereby, the belts may be replaced by a skilled user and/or a service personnel having expertise in the replacement.

SUMMARY OF THE INVENTION

According to an aspect of the invention, an image forming apparatus includes a belt unit. This belt unit includes a support roller, a tension roller, a pair of side frames, a belt, and a guiding mechanism. The pair of side frames are configured to support the support roller and the tension roller. The belt extends across the support roller and the tension roller. The guiding mechanism are configured to guide the tension roller of the belt unit.

According to another aspect of the invention, an image forming apparatus includes a belt unit. This belt unit includes two or more support rollers, a frame mechanism, a belt, and a regulation mechanism. The frame mechanism is configured to support the two or more support rollers. The belt extends across the two or more support rollers. The regulation mechanism is configured to regulate a position of at least one of the two or more support rollers in an axial direction.

BRIEF DESCRIPTION OF THE DRAWINGS

A more complete appreciation of the exemplary aspects of the invention and many of the attendant advantage thereof will be readily obtained as the same becomes better understood by reference to the following detailed description when considered in connection with the accompanying drawings, wherein.

DETAILED DESCRIPTION OF EXEMPLARY EMBODIMENTS

Figure 1:
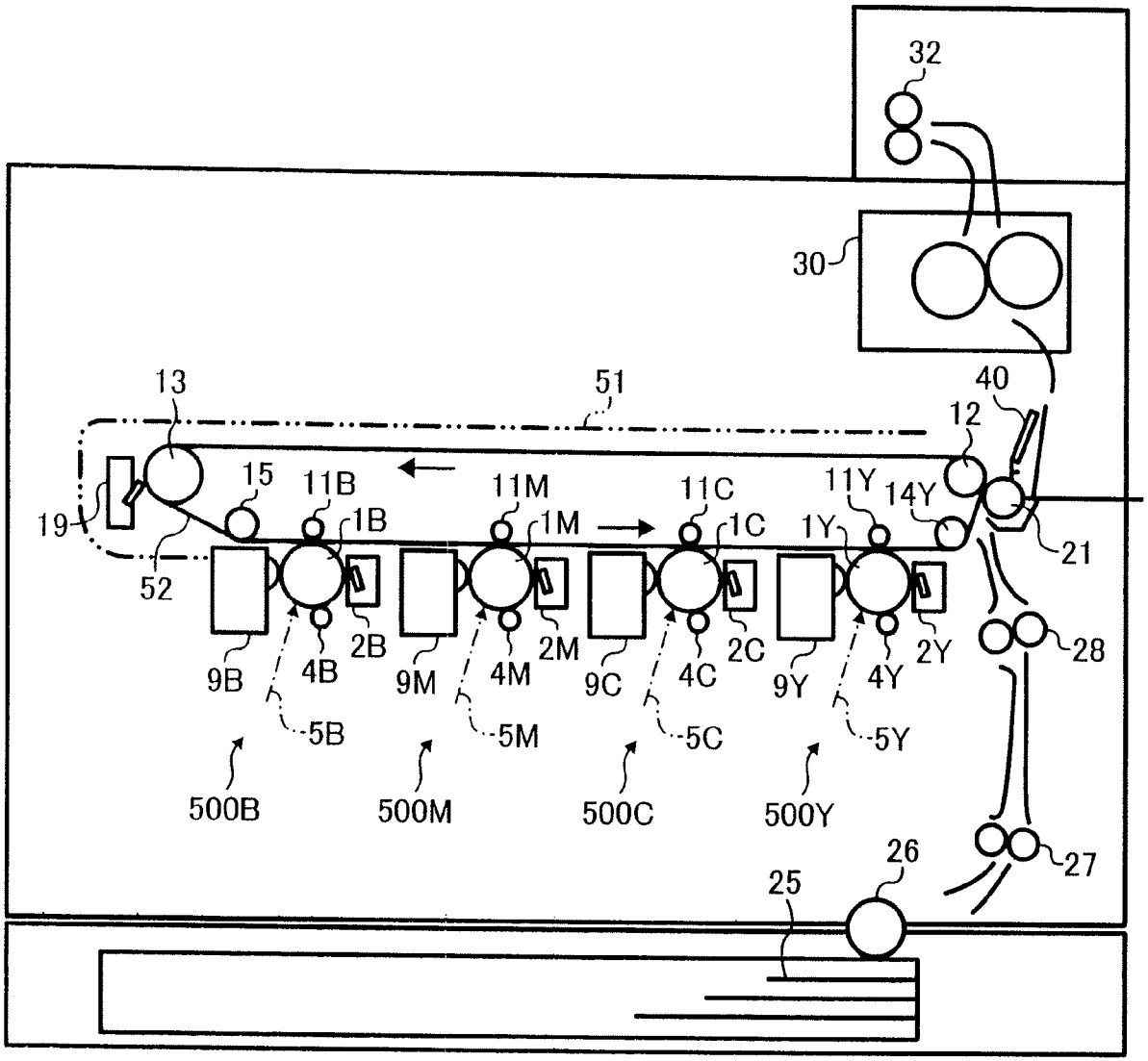
FIG. 1 is a schematic diagram illustrating an image forming apparatus according to an exemplary embodiment of the present invention.

In describing exemplary embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner. Referring now to the drawings, wherein like reference numerals designate identical or corresponding parts throughout the several views, an image forming apparatus according to an exemplary embodiment of the present invention is described.

Referring to FIG. 1, the image forming apparatus employing an electrophotographic method with a tandem system includes image forming units 500B, 500M, 500C, and 500Y, an intermediate transfer belt unit 51, a secondary transfer roller 21, a transfer sheet 25, a feed roller 26, a pair of conveyance rollers 27, registration rollers 28, a sheet guider 40, a fixing device 30, and ejection rollers 32. The image forming unit 500B includes a photoconductor 1B, a cleaning devices 2B, a charging devices 4B, and a development devices 9B. The image forming unit 500M includes a photoconductor 1M, a cleaning device 2M, a charging device 4M, and a development device 9M. The image forming unit 500C includes a photoconductor 1C, a cleaning device 2C, a charging device 4C, and a development device 9C. The image forming unit 500Y includes a photoconductor 1Y, a cleaning device 2Y, a charging device 4Y, and a development device 9Y.

The intermediate transfer belt unit 51 includes an intermediate transfer belt 52, transfer bias rollers 11B, 11M, 11C, and 11Y, a driving roller 12, a tension roller 13, a first driven roller 14, a second driven roller 15, and a belt cleaning device 19.

The image forming units 500B, 500M, 500C, and 500Y carry electrostatic latent images formed on the photoconductors 1B, 1M, 1C, and 1Y, respectively so as to develop the electrostatic latent images with toner by the development units 9B, 9M, 9C, and 9Y, respectively. When the electrostatic latent images are formed, the charging devices 4B, 4M, 4C, and 4Y uniformly charge surfaces of the photoconductors 1B, 1M, 1C, and 1Y, respectively. The photoconductors 1B, 1M, 1C, and 1Y form the electrostatic latent images thereon by irradiation of lights applied from an optical writing unit (not shown). The lights from the optical writing unit are indicated as 5B, 5M, 5C, and 5Y with arrows in FIG. 1. The development devices 9B, 9M, 9C, and 9Y develop the electrostatic latent images on the photoconductors 1B, 1M, 1C, and 1Y, respectively, to form the toner images. The cleaning devices 2B, 2M, 2C, and 2Y clean the photoconductors 1B, 1M, 1C, and 1Y, respectively.

The intermediate transfer belt unit 51 is a detachable unit with respect to the image forming apparatus, and transfers the toner image developed by the development devices 9B, 9M, 9C, and 9Y onto the intermediate transfer belt 52. A detail description of the intermediate transfer belt unit 51 will be given in FIG. 2B and FIG. 2C. The intermediate transfer belt 52 is a transfer member onto which the toner images are transferred. The transfer bias rollers 11B, 11M, 11C, and 11Y transfer the toner images on photoconductors 1B, 1M, 1C, and 1Y, respectively, onto the intermediate transfer belt 52. The driving roller 12 drives the intermediate transfer belt 52. The tension roller 13 provides tension to the intermediate transfer belt 52. The first and second driven rollers 14 and 15 support the intermediate transfer belt 52 so as to rotate the transfer belt 52. The belt cleaning device 19 removes remaining toner from the intermediate transfer belt 52 after the toner images are secondarily transferred onto the transfer sheet 25.

The secondary transfer roller 21 transfers the toner images from the intermediate transfer belt 52 onto the transfer sheet 25. For example, the transfer sheet 25 is a sheet of paper on which the toner images are transferred. The feed roller 26 feeds the transfer sheet 25. The pair of conveyance rollers 27 convey the transfer sheet 25 towards the registration rollers 28. The registration rollers 28 register the transfer sheet 25. The sheet guider 40 guides the transfer sheet 25 to the fixing device 30. The fixing device 30 fixes the toner images on the transfer paper 25. The ejection rollers 32 eject the transfer sheet 25 on which the toner images are fixed.

According to an example, as shown in FIG. 1, the intermediate transfer belt 52 extends across the driving roller 12, tension roller 13, and first and second driven rollers 14 and 15. The driving roller 12 is disposed opposing the secondary transfer roller 21 that is disposed opposing a front-surface of the intermediate transfer belt 52. The image forming units 500B, 500M, 500C, and 500Y are disposed below the intermediate transfer belt 52 along a belt movement direction. The intermediate transfer belt 52 has the transfer bias rollers 11B, 11M, 11C, and 11Y at a back-surface thereof so that the transfer bias rollers 11B, 11M, 11C, and 11Y are disposed opposing the photoconductors 1B, 1M, 1C, and 1Y, respectively. The intermediate transfer belt unit 51 has a frame that may hold the belt cleaning device 19. However, the belt cleaning device 19 may be held by a main body of the image forming apparatus. The main body of the image forming apparatus includes the feed roller 26, conveyance rollers 27, registration rollers 28, secondary transfer roller 21, sheet guider 40, fixing device 30, and ejection rollers 32.

Therefore, the toner images developed by the development devices 9B, 9C, 9M, and 9Y on the photoconductors 1B, 1M, 1C, and 1Y, respectively, in the image forming units 500B, 500C, 500M, and 500Y, respectively, are superimposed on one another on the intermediate transfer belt 52 so as to be secondarily transferred onto the transfer sheet 25 by the secondary transfer roller 21. When the toner images are secondarily transferred on to the transfer sheet 25, the guider 40 guides the transfer sheet 25 to the fixing device 30 in which the toner images are fixed. The transfer paper with the fixed toner images are ejected by the ejection roller 32 so as to be stacked in a stacking area (not shown).

According to this example, since this image forming apparatus employs the tandem system, four image forming units 500B, 500C, 500M, and 500Y are disposed for respective four color components, black, cyan, magenta, and yellow which are abbreviated as B, C, M, and Y, respectively. These color abbreviations may be omitted as necessary throughout the several views.

Figure 2A:
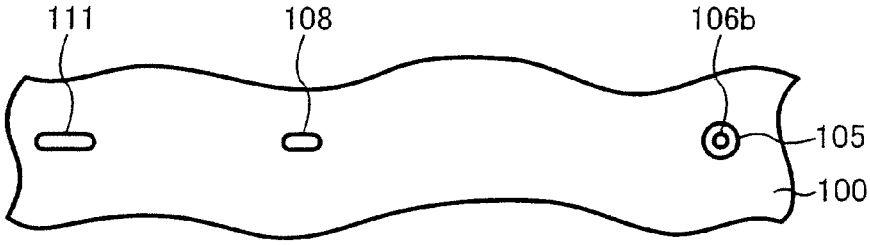
FIG. 2A is a schematic front view of a rear side plate of the image forming apparatus of FIG. 1.

The image forming apparatus of this example has a rear side plate 100, shown in a rear side of FIG. 2A.

Referring to FIG. 2A, the rear side plate 100 includes a first elongated hole 111, and a second elongated hole 108, a substantially circular hole 106*b*, and a coupling 105. As shown in FIG. 2A, the first and second elongated holes 111 and 108 are disposed in a substantially horizontal direction, and the coupling 105 is positioned in a center of the hole 106*b*. FIG. 2A provides a basis for a more detailed description of the intermediate transfer belt unit 51 shown in FIG. 2B and FIG. 2C.

Figure 2B:
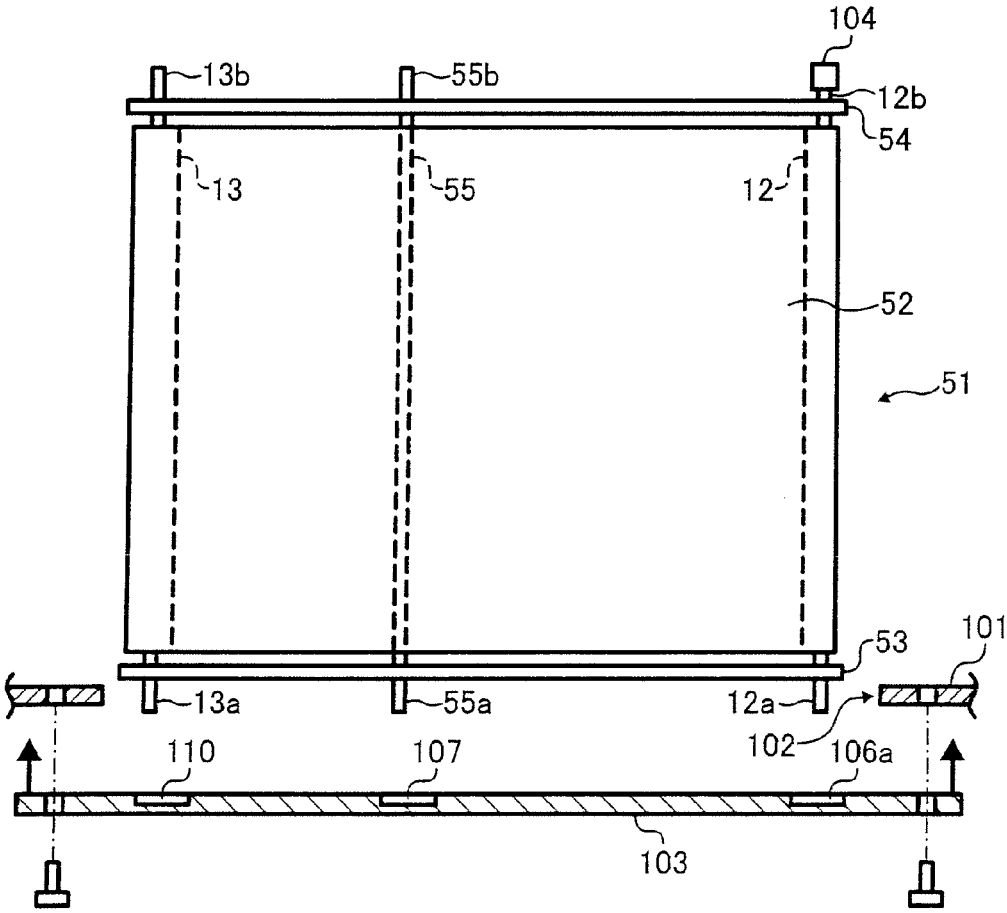
FIG. 2B is a schematic top view of an intermediate transfer belt unit included in the image forming apparatus of FIG. 1.

Referring to FIG. 2B, the intermediate transfer belt unit 51 of FIG. 1 is illustrated in a schematic top view. Reference numerals included in FIG. 1 designate identical or corresponding parts in FIG. 2B, and detailed descriptions thereof may be omitted in FIG. 2B.

In the example shown in FIG. 2B, the intermediate transfer belt unit 51 has an apparatus side plate 101, an opening 102, and a face plate 103 in a front vicinity thereof. The opening 102 is used to detach and attach the intermediate transfer belt unit 51. The face plate 103 is mounted to the apparatus side plate 101 with a mounting member, such as a screw, in such a manner that the opening 102 is covered as shown by the arrows in FIG. 2B.

The intermediate transfer belt unit 51 includes a front frame 53, a rear frame 54, a coil spring 56 (shown in FIG. 2C), the driving roller 12, the tension roller 13, and the first and second driven rollers 14 and 15. The front and rear frames 53 and 54 hold intermediate transfer elements, for example, the driving roller 12. The coil spring 56 is a biasing member to provide tension to the tension roller 13. The front and rear frames 53 and 54 support both ends of the driving roller 12 through bearings. The driving roller 12 has a first shaft 12*a* and a second shaft 12*b* extending from the bearings towards outside. These first and second shafts 12*a* and 12*b* may function as reference shafts when the intermediate transfer belt unit 51 is mounted to the main body of the image forming apparatus.

As shown in FIG. 2B, the second shaft 12*b* has a coupling 104 securing thereto for a driving input. The second shaft 12*b* is protruded from the coupling 104 in a rearward direction, and functions as the reference shaft. The second shaft 12*b* is input to a center of the coupling 105 in the circular hole 106*b* of the rear side plate 100 of FIG. 2A so as to function as the reference shaft. The first shaft 12*a* is input to a circular hole 106*a* in the front plate 103.

In this example, when the first and second shafts 12*a* and 12*b* are respectively input to the circular holes 106*a* and 106*b*, positions of the first and second shafts 12*a* and 12*b* are regulated. The first and second shafts 12*a* and 12*b* functioning as the reference shafts to be input to the circular holes 106*a* and 106*b*, may be substituted by another positioning configuration. For example, flanges may be disposed for the substitution at locations of the bearings so as to be positioned at flange steadies located in side plates of the image forming apparatus main body. The reference shafts are configured to be positioned in substantially horizontal and substantially vertical directions of the side plates of the image forming apparatus main body. The front and rear frames 53 and 54 have a shaft 55 therebetween. The shaft 55 has first and second sub-shafts 55*a* and 55*b* extending from the front and rear frames 53 and 54 towards outsides. The first and second sub-shafts 55*a* and 55*b* are used as sub-reference shafts. The sub-reference shafts may not be regulated in a certain direction of the side plates of the image forming apparatus main body.

As shown in the example of FIG. 2B, the rear side plate 100 and the face plate 103 have a third elongated hole 107 and the second elongated hole 108 respectively in the horizontal direction. The sub-shafts 55*a* and 55*b* are respectively input to the elongated holes 107 and 108 so as to be regulated in the vertical direction. As the positions of the sub-shafts 55*a* and 55*b* are regulated in the vertical direction, a holding capability with respect to gravity may be provided. The front and rear frames 53 and 54 have a fifth elongated hole 109*a* (shown in FIG. 2C) and a sixth elongated hole 109*b* (not shown) respectively in the horizontal direction. The rear side plate 100 and the face plate 103 have the first elongated hole 111 and a fourth elongated hole 110 respectively in the horizontal direction. The tension roller 13 capable of moving in the horizontal direction has a third shaft 13*a* and a forth shaft 13*b* respectively extending from the first and second frame 53 and 54 towards outside. The third and fourth shafts 13*a* and 13*b* are respectively input to the fourth and first elongated holes 110 and 111 through the fifth and sixth elongated holes 109*a* and 109*b* so that the tension roller 13 may be held in the horizontal direction.

Figure 2C:
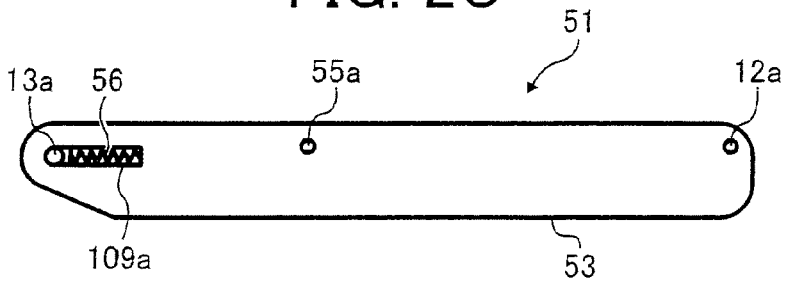
FIG. 2C is a schematic front view of the intermediate transfer belt unit of FIG. 2B.

Referring to FIG. 2C, the intermediate transfer unit 51 included in FIG. 2B is illustrated in a schematic front view. The reference numerals included in FIG. 1, FIG. 2A, and FIG. 2B designate identical or corresponding parts in FIG. 2C, and detailed descriptions thereof may be omitted in FIG. 2C. The FIG. 2C may be used to support the detailed description of the rear side plate 100 in FIG. 2A and the intermediate transfer belt unit 51 in FIG. 2B.

According to the example shown in FIG. 1 though FIG. 2C, the driving roller 12 and the tension roller 13 can be positioned by the side plates of the image forming apparatus main body in a top-and-bottom direction. Accordingly, the intermediate transfer belt unit 51 may reduce or eliminate an occurrence of a twist thereto caused by mispositioning of the driving roller 12 and the tension roller 13 in the side plates in the top-and-bottom direction. Consequently, the belt 52 may travel at a stable level so as to reduce or eliminate an occurrence of inconvenience such as skewing thereof. For example, when the intermediate transfer belt unit 51 is mounted obliquely in the image forming apparatus, the intermediate transfer unit 51 may reduce or eliminate an occurrence of the twist thereof in an oblique direction. The reference shafts, sub-reference shafts, coupling 105, holes 106, 107, 108, 110, and 111 have bottoms, and a leading end of each shaft and roller is abutted on respective bottoms so as to be regulated in a width direction. Therefore, the tension roller 13 and driving roller 12 may reduce or eliminate an occurrence of the mispositioning therebetween in an axial direction, and the belt 52 may reduce or eliminate occurrence of inconvenience such as meandering thereof.

Another example of the image forming apparatus will be described in FIG. 3A and FIG. 3B. Reference numerals included in FIG. 1 though FIG. 2C designate identical or corresponding parts in FIG. 3A and FIG. 3B, and detailed descriptions thereof may be omitted in FIG. 3A and FIG. 3B.

Figure 3A:
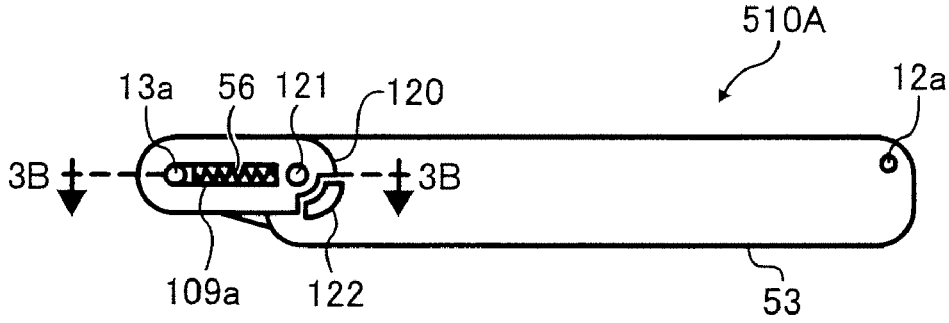
FIG. 3A is a schematic front view of an intermediate transfer belt unit according to another exemplary embodiment of the present invention.

Referring to FIG. 3A, an intermediate transfer unit 510A is illustrated in a schematic front view. This intermediate transfer unit 510A is similar to the intermediate transfer unit 51 of FIG. 2C, except for a small frame or bracket 120, a support shaft 121, and a stopper 122. As shown in FIG. 3A, the small frame 120 holds the third shaft 13*a* included in the tension roller 13. The small frame 120 is mounted to the front frame 53 so as to be rotatable about the support shaft 121 in such a manner that the tension roller 13 integrally rotates with the small frame 120. The support shaft 121 functions substantially similar to the sub-reference shaft of the shaft 55 included in FIG. 2B. The intermediate transfer unit 510A has the rear frame 54 disposed in a rear area thereof that may be configured substantially similar to the front frame 53 in a front area thereof. The support shaft 121 has shafts 121*a* (shown in FIG. 3B) and 121*b* (not shown) that are respectively extended from the front and rear frames 53 and 54 towards outside. These shafts 121*a* and 121*b* are input to the second and third elongate holes 108 and 107 included in the rear side plate 100 and the face plate 103 respectively so that the support shaft 121 functions as the sub-reference shaft. A dashed line 3B-3B with arrows illustrates a cross section shown in FIG. 3B.

Figure 3B:
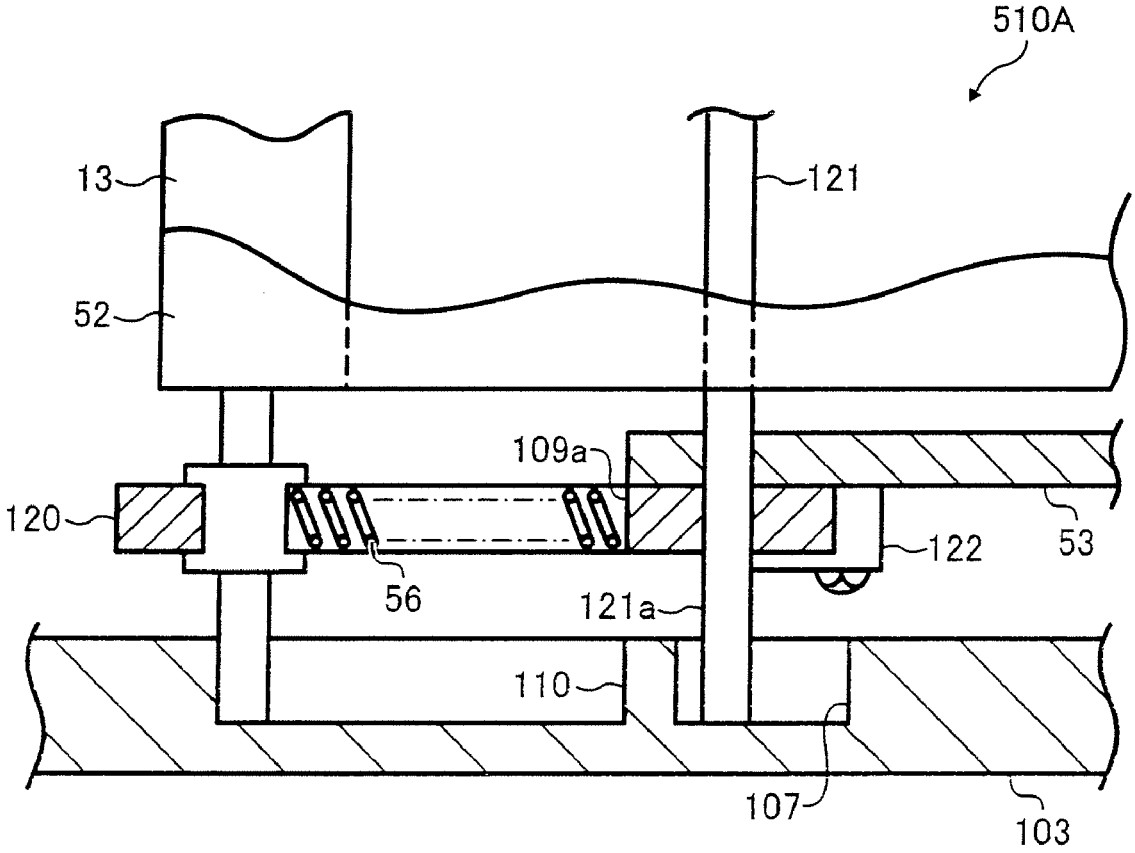
FIG. 3B is an enlarged partial top view of the intermediate transfer belt unit of FIG. 3A.

Referring to FIG. 3B, the intermediate transfer unit 510A included in FIG. 3A is shown in an enlarged sectional view. This top view partially illustrates the front area of the intermediate transfer unit 510A. The intermediate transfer unit 510A has the rear area that may be configured substantially similar to the front area shown in FIG. 3B.

For example, as shown in FIG. 3B, the small frame 120 has the spring 56 and the elongated hole 190*a* at which the bearing of the tension roller 13 is supported. The front frame 53 has the stopper 122 which regulates a rotation angle of the support shaft 121 of the small frame 120. According to this exemplary embodiment, the tension roller 13 is supported by the small frame 120 so as to be separated from the front and rear frames 53 and 54. Thereby, the front and rear frames 53 and 54 may reduce or eliminate an occurrence of having an influence, for example, a pressure from the biasing member such as the spring 56, and a load such as a weight applied from the belt cleaning device 19.

As shown in FIG. 3B, the support shaft 121 functions as the sub-reference shaft of the intermediate transfer belt unit 510A so that the front and rear frames 53 and 54 are respectively supported to the side plates 101 and 100 of FIG. 2A through the sub-reference shaft. The front frame 53 is supported to the side plate 101 through the face plate 103 and the sub-reference shaft. Therefore, the front and rear frames 53 and 54 may reduce or eliminate the occurrence of having influence exerted by the tension roller 13, for example. In other words, the front and rear frames 53 and 54 may reduce or eliminate an occurrence of having deformation in the vicinity supporting the support shaft 121 caused by the weight, for example, applied by the tension roller 13 to the support shaft 121 of the small frame 120. The stopper 122 can be detachable and is mounted to the front frame 53 with the mounting member, such as a screw. When the stopper 122 is detached, the small frame 120 may increase a rotatability thereof. When the small frame 120 is folded with respect to the front frame 53 with the stopper 122 detached, the intermediate transfer belt 52 may be detached and attached easily. The small frame 120 may be used to detach and attach the transfer belt 52. Therefore, the inter mediate transfer unit 510A may be configured to be less complex, and a cost thereof may be reduced.

Figure 4A:
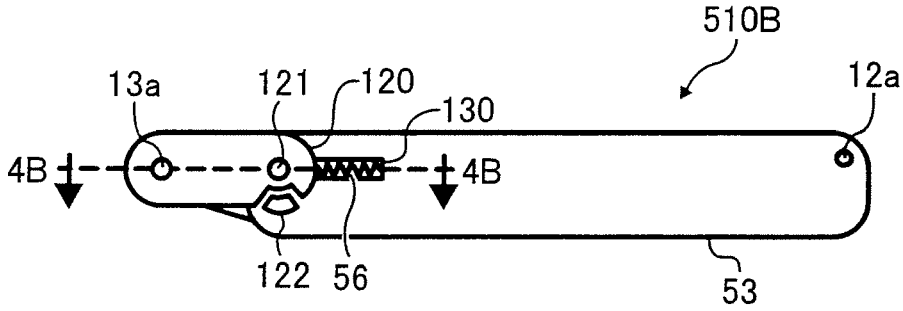
FIG. 4A is a schematic front view of an intermediate transfer belt unit according to another exemplary embodiment of the present invention.
Figure 4B:
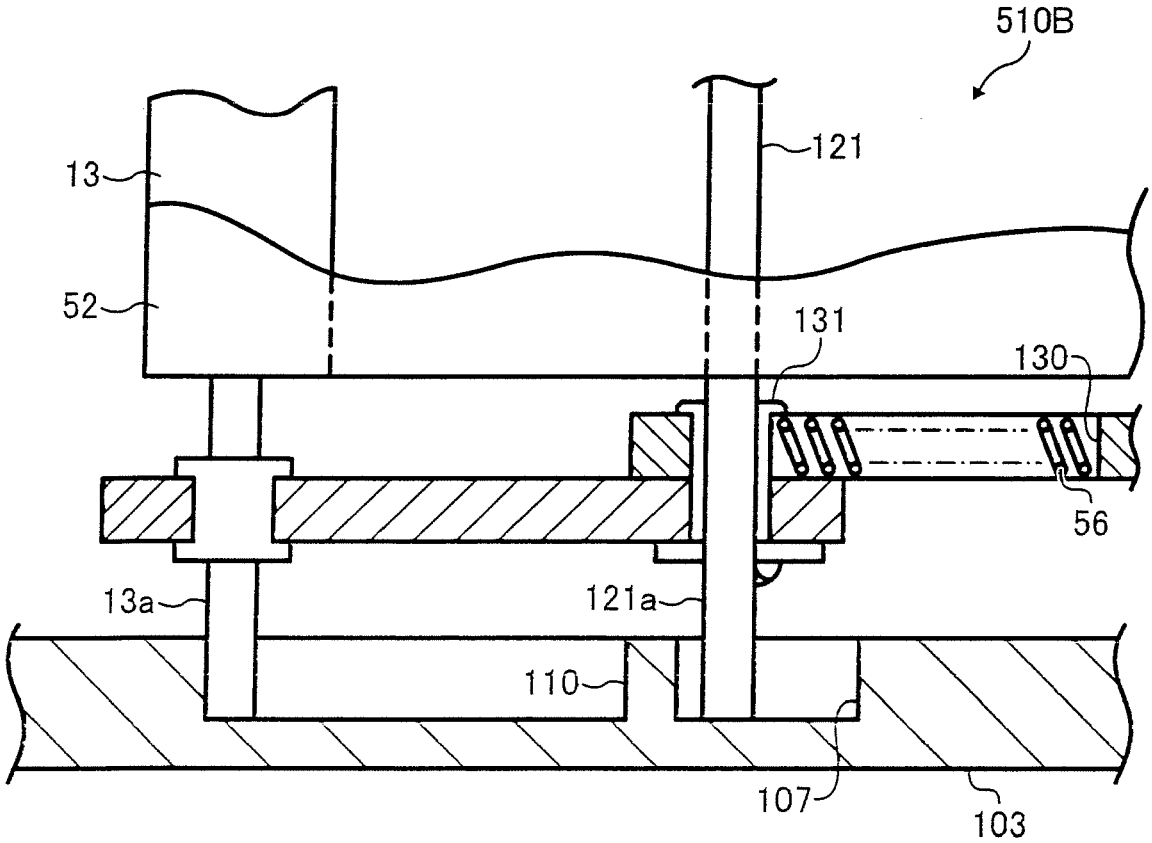
FIG. 4B is an enlarged partial top view of the intermediate transfer belt unit of FIG. 4A.

Still another exemplary embodiment will be illustrated in FIG. 4A and FIG. 4B. Reference numerals included in FIG. 1 though FIG. 3B designate identical or corresponding parts in FIG. 4A and FIG. 4B, and detailed descriptions thereof may be omitted in FIG. 4A and FIG. 4B.

Referring to FIG. 4A, the intermediate transfer belt unit 510B is illustrated in a schematic front view. This intermediate transfer unit 510B is similar to the intermediate transfer unit 510A in FIG. 3A, except for a seventh elongated hole 130 in the horizontal direction. For example, the tension roller 13 having the shaft 13*a* is mounted to the small frame 120 in a position so as to be rotatable. The small frame 120 as a whole is mounted in a tension direction with respect to the front frame 53 so as to be movable. The coil spring 56 is disposed to provide the tension to the intermediate transfer belt 52. A dashed line 4B-4B with arrows illustrates a cross section shown in FIG. 4B.

Referring to FIG. 4B, the intermediate transfer unit 510B included in FIG. 4A is enlarged in a top view. This top view partially illustrates the front area of the intermediate transfer unit 510B. This intermediate transfer unit 510B is similar to the intermediate transfer unit 510A in FIG. 3B, except for the seventh elongated hole 130 and a bearing 131. The intermediate transfer unit 510B has a rear area that may be configured substantially similar to the front area shown in FIG. 4B.

The frame 53 has the seventh elongated hole 130 in the horizontal direction. The support shaft 121 of the small frame 120 is mounted to the elongated hole 130 so as to be slidable. The support shaft 121 has bearings 131 at both ends thereof. The support shaft 121 is mounted in contact with at least one of an inside circumference surface of the elongated hole 130 and a circumference surface of the bearing 131 so as to be slidable. The coil spring 56 and the support shaft 121 capable of sliding in the elongated hole 130 are mounted in such a manner that tension is provided to the intermediate transfer belt 52.

According to this exemplary embodiment, the small frame 120 may not need a space to mount the biasing member so that the opening may not be needed. Thereby, the small frame 120 may reduce or eliminate an occurrence of having a lower strength caused by forming the opening. Therefore, the small frame 120 may be configured to be less complex, and a cost thereof may be reduced.

According to one or more exemplary embodiments above, each of the intermediate transfer belt units has the roller to primarily transfer the image onto an outer circumference of the intermediate transfer belt from the image carrying members disposed along the outer circumference of the intermediate transfer belt. The intermediate transfer belt travels at the stable level so as to reduce or eliminate an occurrence of an inconvenience, for example, skewing thereof. At least one of the exemplary embodiments may apply to the transfer conveyance belt unit that conveys a recording medium on which the image is recorded and transfers the image on the image carrying member onto the recoding medium. Here, the transfer conveyance belt travels at the stable level so as to reduce an occurrence of the inconvenience such as skewing thereof. The configuration of the intermediate transfer belt unit stated above may apply to the transfer conveyance belt unit. At least one of the exemplary embodiments may apply to other belt units, for example, a photoconductor unit in a belt style.

Numerous additional modifications and variations are possible in light of the above teachings. It is therefore to be understood that within the scope of the appended claims, the disclosure of this patent specification may be practiced otherwise than as specifically described herein.

The invention claimed is:

1. An image forming apparatus, comprising:

a belt unit including:

a support roller;

a tension roller;

a pair of side frames configured to support the support roller and the tension roller;

a belt extending across the support roller and the tension roller; and a bracket linked to one end of the each of the pair of side frames and configured to support the tension roller and to be integrally rotatable together with the tension roller with respect to a corresponding one of the pair of side frames.

2. The image forming apparatus of claim 1, wherein the belt unit is detachably installable to the image forming apparatus.

3. The image forming apparatus of claim 1, wherein the belt unit further includes a driving roller configured to be driven to move the belt and including a shaft, wherein the shaft of the driving roller is used as a main reference member to determine a position of the belt unit relative to the image forming apparatus.

4. The image forming apparatus of claim 1, wherein the tension roller includes a shaft around which the bracket is rotated integrally with the tension roller with respect to a corresponding one of the pair of side frames, the shaft being used as an auxiliary reference member to determine a position of the belt unit relative to the image forming apparatus.

5. The image forming apparatus of claim 1, wherein the bracket is rotatable to release the belt from the belt unit.

6. The image forming apparatus of claim 4, wherein the tension roller is held for movement relative to the pair of side frames, and the bracket includes a biasing mechanism connecting the bracket to a corresponding one of the pair of side frames and configured to apply a force to the bracket to move away from the corresponding one of the pair of side frames.

7. The image forming apparatus of claim 1, further comprising a regulation member to regulate a position of the tension roller in an axis direction.

8. An image forming apparatus, comprising:

a belt unit including:

two or more support rollers;

a frame mechanism configured to support the two or more support rollers;

a belt extended across the two or more support rollers;

a regulation mechanism configured to regulate a position of at least one of the two or more support rollers in an axis direction, the regulation mechanism regulates the position of the at least one of the two or more support rollers in the axis direction by holding ends of the at least one of the two or more support rollers or ends of a shaft of the at least one of the two or more support rollers; and a holding device located between the regulation mechanism and the frame mechanism, the holding device configured to support the at least one support roller and be integrally rotatable therewith.

9. The image forming apparatus of claim 8, wherein the belt unit is detachably installable to the image forming apparatus.

10. The image forming apparatus of claim 8, wherein the belt unit includes an intermediate transfer unit.

11. The image forming apparatus of claim 8, wherein the belt unit includes a transfer conveyance belt unit.

* * * * *